US007207629B2

(12) United States Patent
Goetz et al.

(10) Patent No.: US 7,207,629 B2
(45) Date of Patent: Apr. 24, 2007

(54) TILT CHAIR

(75) Inventors: Mark W. Goetz, Brooklyn, NY (US); Robert L. Beck, Zeeland, MI (US); Joel R. Dral, Zeeland, MI (US); Robert W. Roth, Holland, MI (US)

(73) Assignee: Herman Miller, Inc., Zeeland, MI (US)

( * ) Notice: Subject to any disclaimer, the term of this patent is extended or adjusted under 35 U.S.C. 154(b) by 223 days.

(21) Appl. No.: 10/860,804

(22) Filed: Jun. 3, 2004

(65) Prior Publication Data

US 2005/0029849 A1 Feb. 10, 2005

Related U.S. Application Data

(60) Provisional application No. 60/480,671, filed on Jun. 23, 2003.

(51) Int. Cl.
*A47C 1/12* (2006.01)

(52) U.S. Cl. ..... 297/318; 297/258.1; 297/340; 297/313; 297/344.15; 297/411.31

(58) Field of Classification Search ..... 297/258.1, 297/259.2, 259.4, 340, 313, 300.2, 451.1, 297/451.7, 344.15, 344.16, 411.31, 318
See application file for complete search history.

(56) References Cited

U.S. PATENT DOCUMENTS

| | | | |
|---|---|---|---|
| 180,548 | A | 8/1876 | Chichester |
| 233,140 | A | 10/1880 | Candrian |
| 366,514 | A | 7/1887 | Scarritt et al. |
| 482,447 | A | 9/1892 | Forney |

(Continued)

FOREIGN PATENT DOCUMENTS

| | | |
|---|---|---|
| DE | 40 41 157 A1 | 12/1990 |

(Continued)

*Primary Examiner*—Laurie K. Cranmer
(74) *Attorney, Agent, or Firm*—Brinks Hofer Gilson & Lione

(57) ABSTRACT

A tilt chair having a foot adapted to be supported by a support surface and a first leg pivotally mounted to the foot. A second leg is pivotally mounted to the first leg. A moveable support member is mounted to the second leg and is adapted to be supported by the support surface. The moveably support member is moveable in a first and second direction toward and away from the foot respectively as the first leg pivots relative to the second leg and as the first leg pivots relative to the foot. In one embodiment, the moveable support member is configured as a wheel. In one embodiment, a lower back member has a lower end pivotally mounted to the first leg and an upper back member pivotally mounted to an upper end of the lower back member. A restraining link is pivotally mounted between the lower back member and the second leg. An upper back link has a lower end pivotally mounted to the first leg and an upper end pivotally mounted to the upper back member. An actuator is operably connected to the first and second legs. A seat support is connected to the second leg, and one or both of an armrest and worksurface are mounted to the seat support. A method of tilting the chair is also provided and includes pivoting the second leg relative to the first leg and thereby rolling the wheel on the floor and pivoting the first leg relative to the foot.

34 Claims, 10 Drawing Sheets

U.S. PATENT DOCUMENTS 2,471,024 A 5/1949 Cramer
2,485,111 A 10/1949 Robins
2,859,799 A 11/1958 Moore
2,859,801 A 11/1958 Moore
3,059,971 A 10/1962 Becker
3,144,270 A * 8/1964 Bilancia ..... 297/180.16
3,337,267 A 8/1967 Rogers, Jr.
3,540,777 A 11/1970 De Beaumont
3,712,666 A 1/1973 Stoll
3,819,229 A 6/1974 Rogers, Jr. et al.
3,844,607 A 10/1974 Re
3,865,432 A 2/1975 Rogers, Jr. et al.
3,871,704 A 3/1975 Shoemaker et al.
3,938,858 A 2/1976 Drabert et al.
3,989,297 A 11/1976 Kerstholt
4,084,850 A 4/1978 Ambasz
4,234,228 A 11/1980 Flamm
4,350,389 A 9/1982 Parsson et al.
4,351,563 A 9/1982 Hattori
4,380,352 A 4/1983 Diffrient
4,502,729 A 3/1985 Locher
4,504,090 A 3/1985 Goldman
4,560,199 A 12/1985 Sapper
4,641,884 A 2/1987 Miyashita et al.
4,685,730 A 8/1987 Linguanotto
4,709,963 A 12/1987 Uecker et al.
4,718,716 A 1/1988 Stumpf et al.
4,753,482 A 6/1988 Warren
4,805,865 A 2/1989 Goforth
4,834,454 A 5/1989 Dicks
4,848,837 A 7/1989 Volkle
4,861,107 A 8/1989 Vidwans et al.
4,962,962 A 10/1990 Machate et al.
4,968,095 A 11/1990 Moyer
4,978,170 A 12/1990 Pelz et al.
4,984,846 A 1/1991 Ekornes
5,026,116 A 6/1991 Dal Monte
5,052,754 A 10/1991 Chimomi
5,058,953 A 10/1991 Takagi et al.
5,062,676 A 11/1991 Mars
5,080,435 A 1/1992 Desanta
5,120,109 A 6/1992 Rangoni
5,209,084 A 5/1993 Robinson et al.
5,213,863 A 5/1993 Dag et al.
5,249,839 A 10/1993 Faiks et al.
5,308,144 A 5/1994 Korn
5,308,145 A 5/1994 Koepke et al.
5,354,120 A 10/1994 Volkle
5,366,274 A 11/1994 Roericht et al.
5,370,443 A 12/1994 Maruyama
5,385,388 A 1/1995 Faiks et al.
5,472,261 A 12/1995 Oplenskdal et al.
5,501,507 A 3/1996 Hummitzsch
5,547,252 A 8/1996 Pfenniger
5,597,203 A 1/1997 Hubbard
5,612,718 A * 3/1997 Bryan ..... 345/168
5,636,898 A 6/1997 Dixon et al.
5,704,689 A 1/1998 Kim
5,868,467 A 2/1999 Moll
5,871,258 A 2/1999 Battey et al.
5,909,923 A 6/1999 DeKraker
5,979,984 A 11/1999 DeKraker et al.
6,056,361 A 5/2000 Cvek
6,086,153 A 7/2000 Heidmann et al.
6,811,220 B2 * 11/2004 Shea et al. ..... 297/313

FOREIGN PATENT DOCUMENTS

DE 42 19 599 A1 6/1992
DE 43 06 546 A1 3/1993
JP 60-113742 6/1985
WO WO 89/06101 7/1989

* cited by examiner

TILT CHAIR

This application claims the benefit of U.S. Provisional Patent Application Ser. No. 60/480,671, filed Jun. 23, 2003, the entire disclosure of which is hereby incorporated herein by reference.

BACKGROUND

The present invention relates generally to tiltable chairs, and in particular, to a tilt chair supported by a wheel that rolls on the floor as the user tilts in the chair.

Tilt chairs of the type typically used in offices and the like are usually configured with a pedestal or other base that supports a tilt control housing. The tilt control housing, in turn, supports a seat and backrest, which are configured to tilt relative to the tilt housing, which remains stationary relative to the floor. As such, the tilt mechanism is typically confined to a relatively small space within the tilt housing, which can present various design limitations and impose greater load requirements on the components that limit the tilting, such as springs and the like. Moreover, additional components, such as the base and casters, must be provided which can add to the overall cost of the chair. Other tilt chairs, such as residential lounge chairs, also provide a tilting action, but are generally heavy. In addition, such chairs typically require a frame to support the tilting mechanism above the floor.

Often, tilt chairs of the office or residential type have a unitary back that tilts rearwardly. Such chairs typically do not support the shoulders and upper back of the user as they tilt rearwardly.

In addition, tilt chairs typically are not configured with a worksurface that moves with the chair. Accordingly, as a user tilts rearwardly, the worksurface is not maintained at the same angle or distance relative to the user, thereby requiring accommodation by the user to achieve a desired position thereof.

SUMMARY

The present inventions are defined by the claims, and nothing in this section should be read as a limitation on those claims. Rather, by way of general introduction and briefly stated, various preferred embodiments are described that relate to a tilt chair having a foot adapted to be supported by a support surface and a first leg pivotally mounted to the foot. A second leg is pivotally mounted to the first leg. A moveable support member is mounted to the second leg. The moveable support member is adapted to be supported by the support surface and is moveable in a first and second direction toward and away from the foot respectively as the first leg pivots relative to the second leg and as the first leg pivots relative to the foot. In one preferred embodiment, the moveable support member is configured as a wheel rotatably mounted to the second leg.

In one embodiment, the tilt chair further includes a lower back member having a lower end pivotally mounted to the first leg. An upper back member is pivotally mounted to an upper end of the lower back member. An upper back link has a lower end pivotally mounted to the first leg and an upper end pivotally mounted to the upper back member. In one embodiment, the tilt chair further includes a restraining link having a first end pivotally mounted to the lower end of the lower back member and a second end pivotally mounted to the second leg.

In one embodiment, the tilt chair further includes an actuator operably connected to the first and second legs at first and second locations.

In another aspect, the tilt chair further includes a seat support connected to the second leg. In one embodiment, an armrest is mounted to the seat support. In another embodiment, a worksurface is mounted to the seat support.

In another aspect, a method of tilting the chair includes pivoting the second leg relative to the first leg and thereby moving the moveable support member on the support surface and pivoting the first leg relative to the foot. In one embodiment, the method further includes pivoting a seat support connected to the second leg relative to first leg and thereby pivoting a worksurface with the seat support relative to the first leg.

The various preferred embodiments provide significant advantages over other tilt chairs and seating structures. For example and without limitation, the wheels roll directly on the supporting surface, such as the floor, thereby avoiding the need for an additional base structure. In addition, various components of the chair make up the tilt linkage, which is not constrained to a control housing. In one embodiment, the linkage allows the seat to move forwardly as the user tilts rearwardly, while at the same time providing support for the upper thoracic area of the user with the upper back member. In this way, the articulated thoracic support maintains the head of the user in an upright position as the user reclines. In addition, the worksurface moves with the seat support, and is thereby maintained in the same position relative to the user as the user moves to a desired tilt position.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

General:

The terms "longitudinal" and "lateral" as used herein are intended to indicate the direction of the chair from front to back and from side to side, respectively. Similarly, the terms "front", "side", "back", "forwardly", "rearwardly", "upwardly" and "downwardly" as used herein are intended to indicate the various directions and portions of the chair as normally understood when viewed from the perspective of a user sitting in the chair.

It should be understood that the terms "mounted," "connected", "coupled," "supported by," and variations thereof, refer to two or more members or components that are joined, whether directly or indirectly, for example, by way of another component or member, and further that the two or more members, or intervening member(s) can be joined by being integrally formed, or by way of various fastening devices, including for example and without limitation, mechanical fasteners, adhesives, welding, press fit, bent-over tab members, etc.

The terms "pivot," "pivotable," "rotate" and "rotatable," and variations thereof, are used interchangeably, and simply refer to the movement or turning of one member or component relative to another about an axis.

Figure 1:
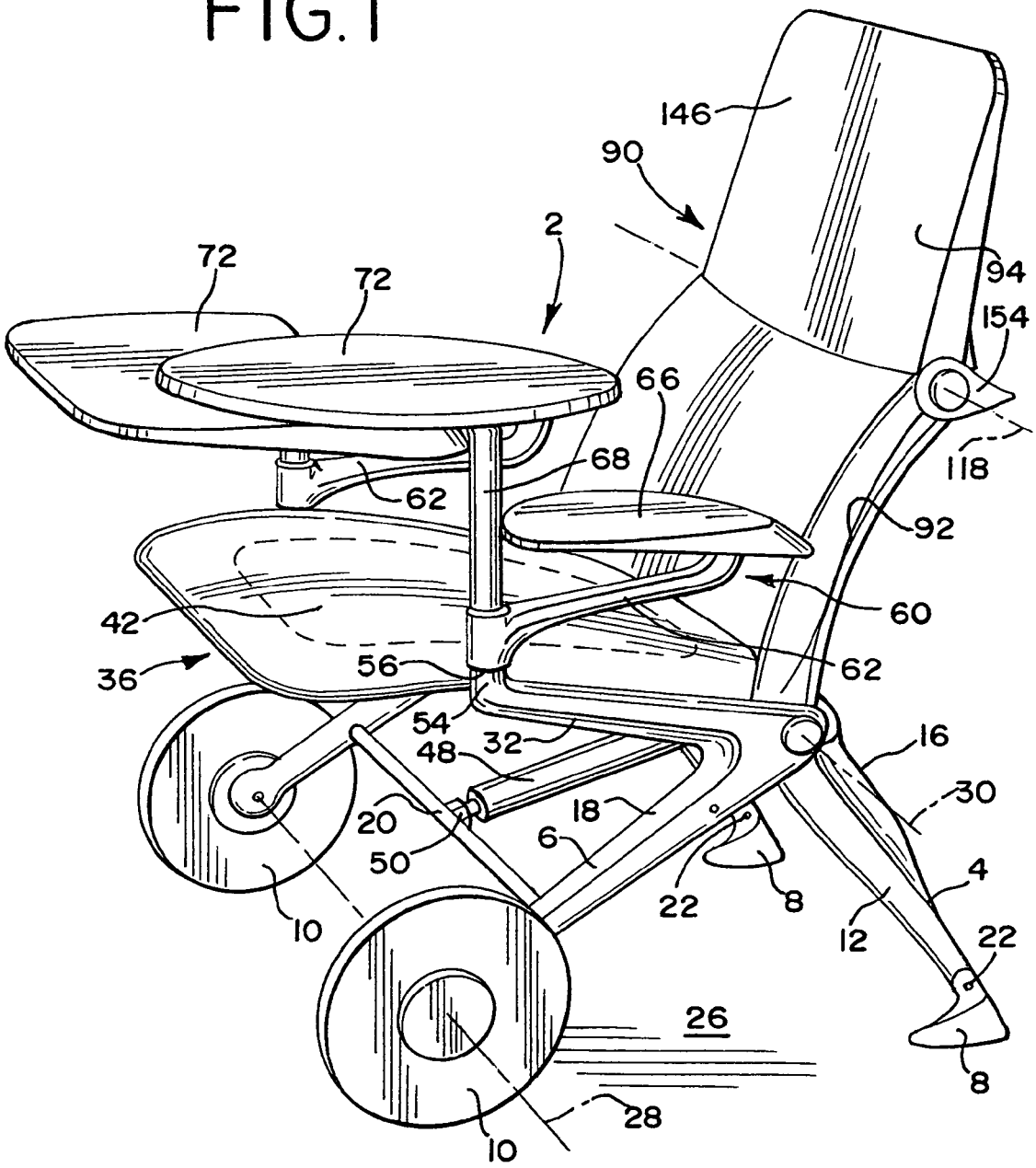
FIG. 1 is a front perspective view of one embodiment of a tilt chair.
Figure 2:
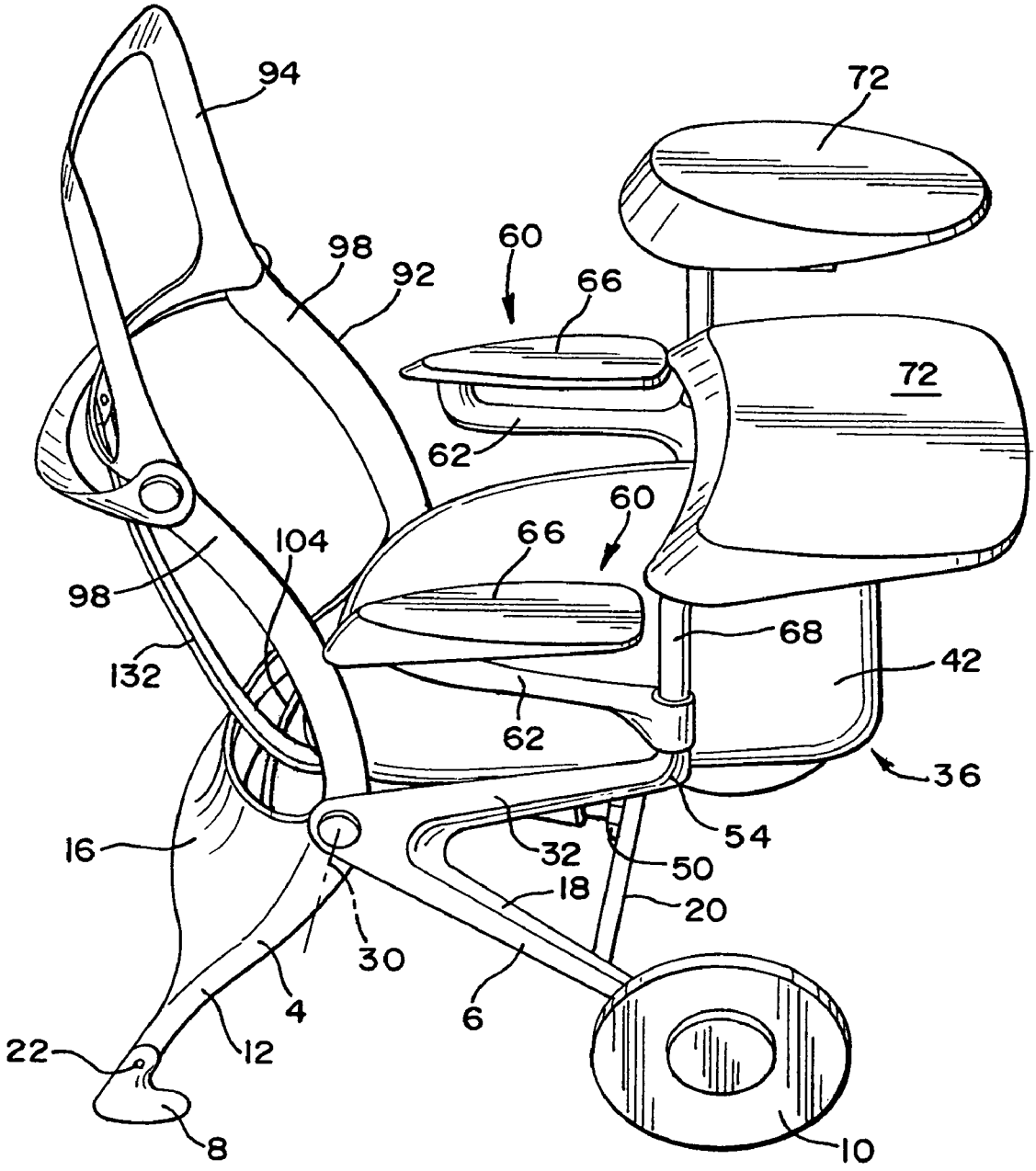
FIG. 2 is a side perspective view of the tilt chair without the seating surfaces.
Figure 3:
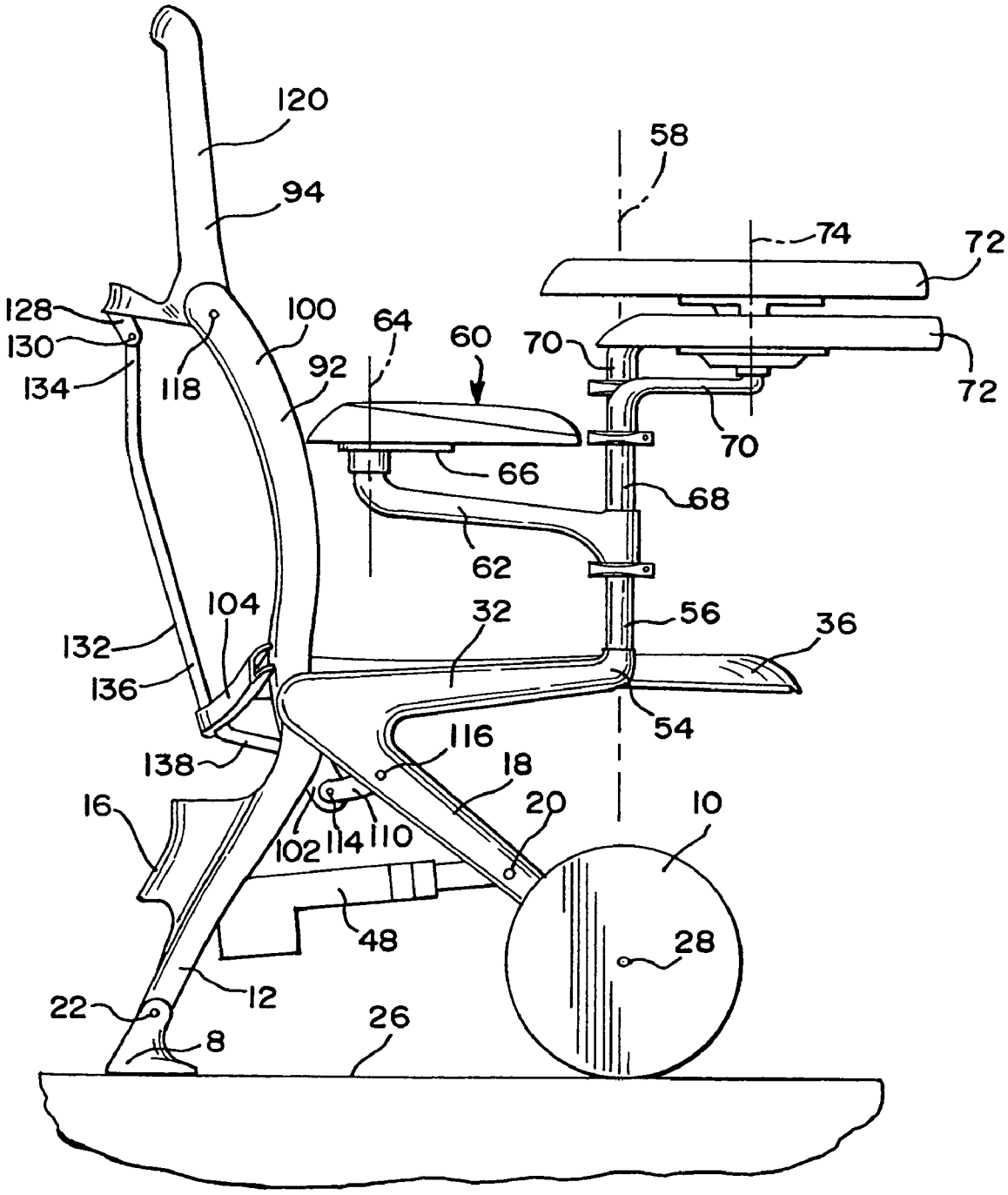
FIG. 3 is a side view of the tilt chair shown in FIG. 2.
Figure 4:
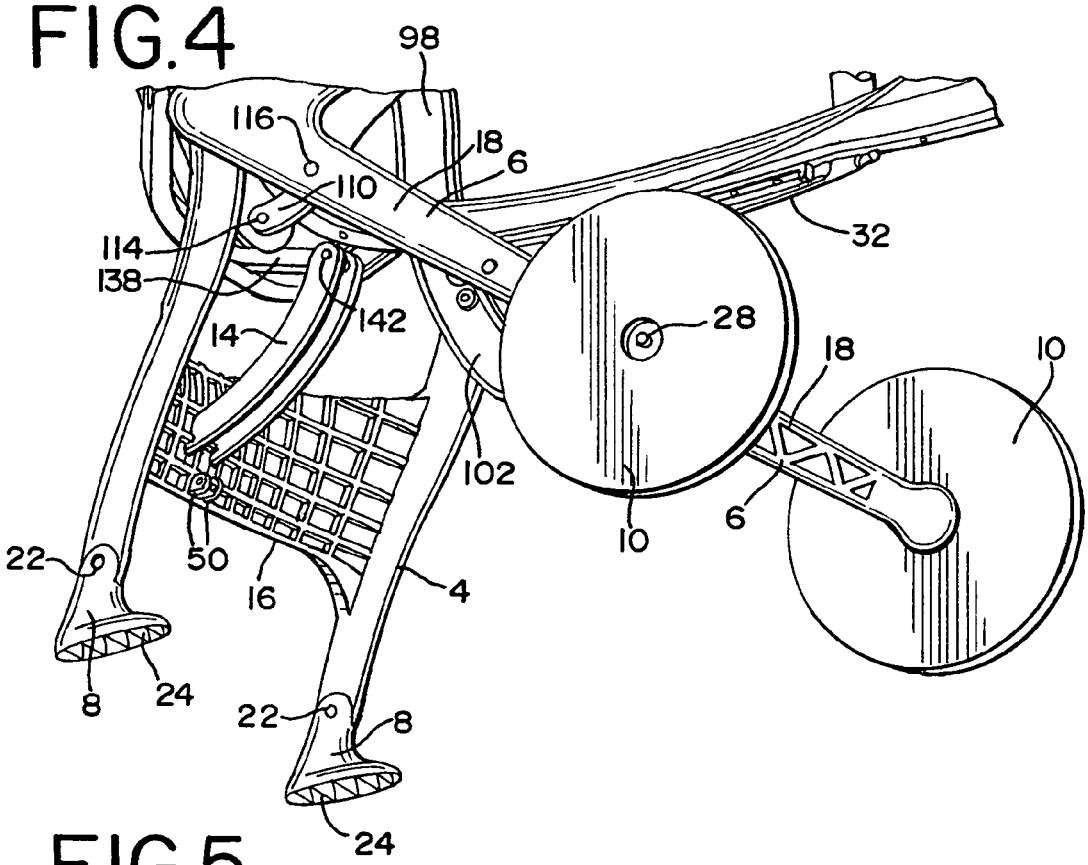
FIG. 4 is a partial bottom perspective view of the tilt chair shown in FIG. 2.
Figure 5:
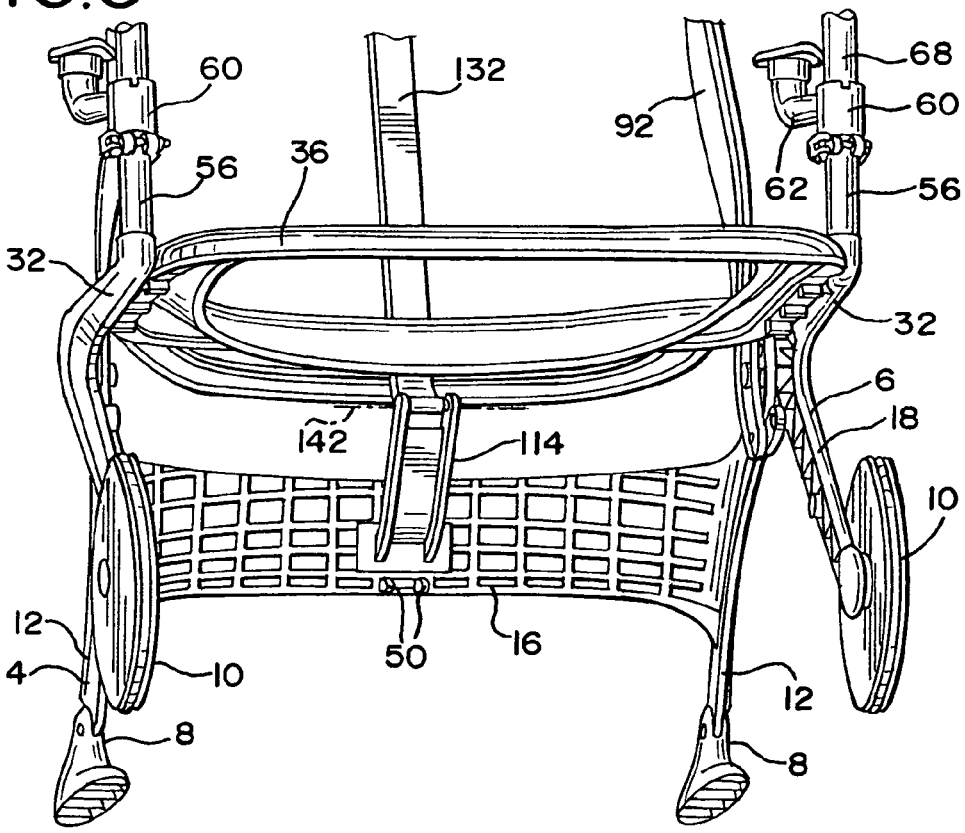
FIG. 5 is a partial front perspective view of the tilt chair shown in FIG. 2.
Figure 6:
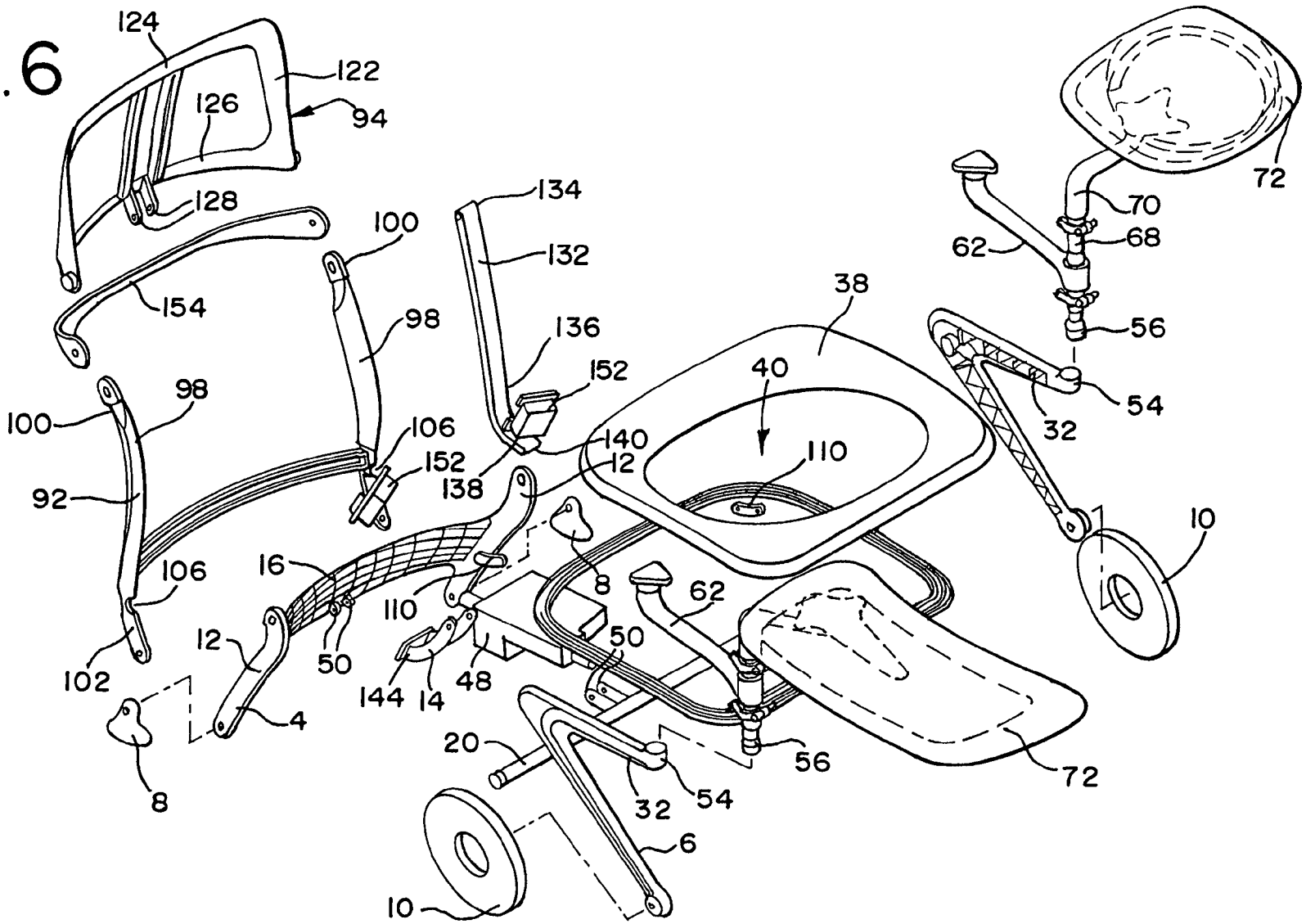
FIG. 6 is an exploded perspective view of the tilt chair without the seating surfaces.
Figure 7:
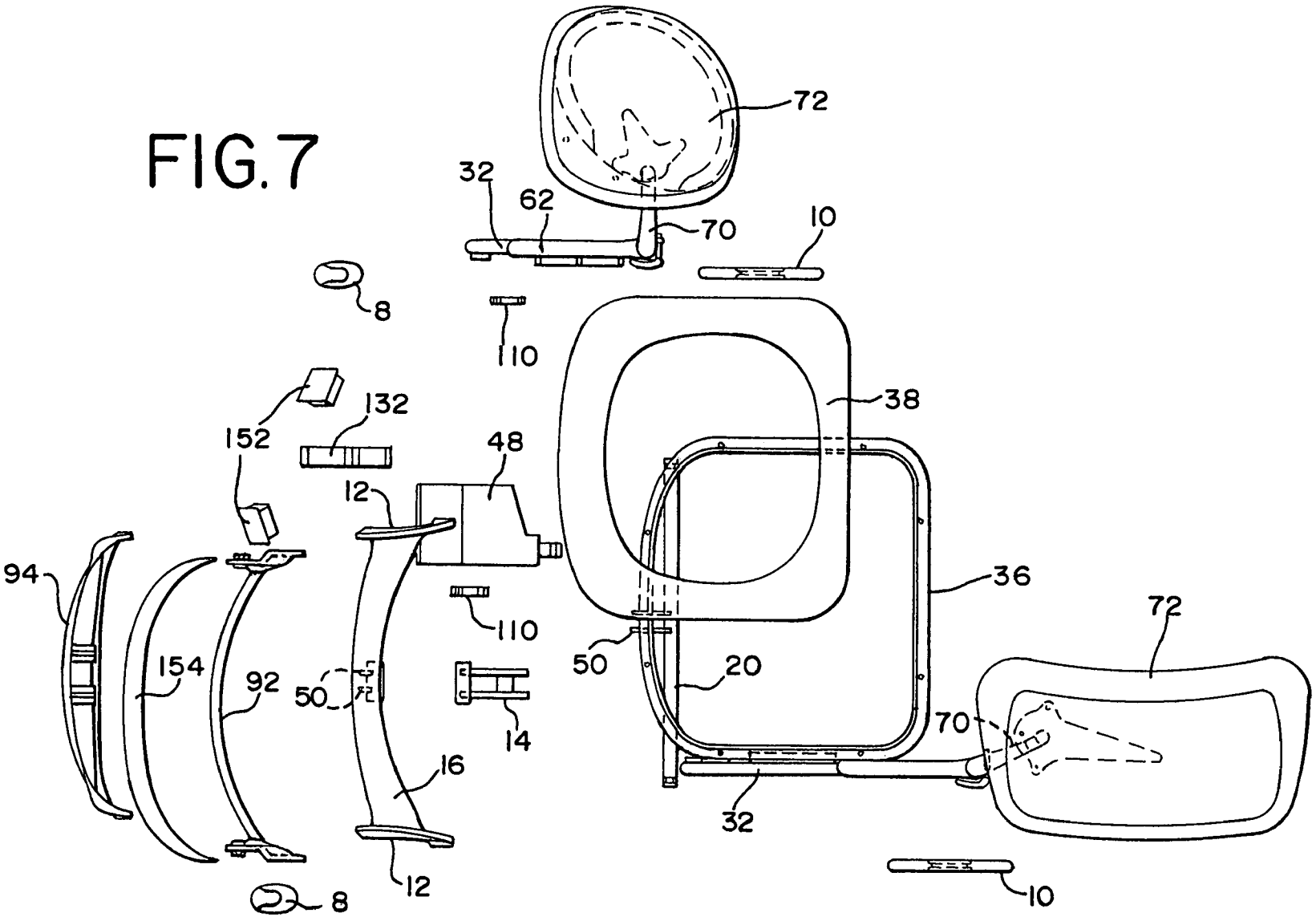
FIG. 7 is an exploded top view of the tilt chair.
Figure 8:
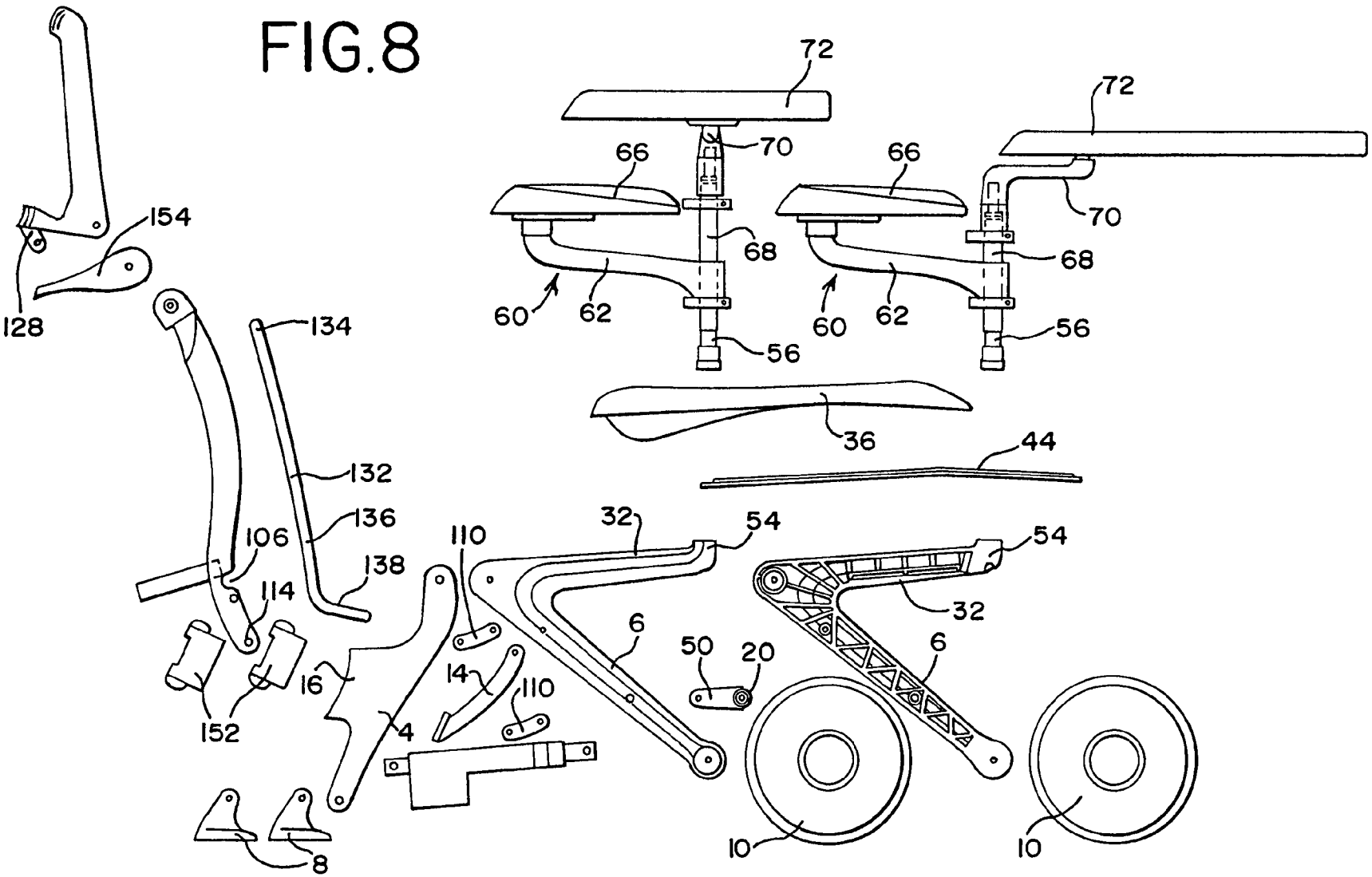
FIG. 8 is an exploded side view of the tilt chair.
Figure 9:
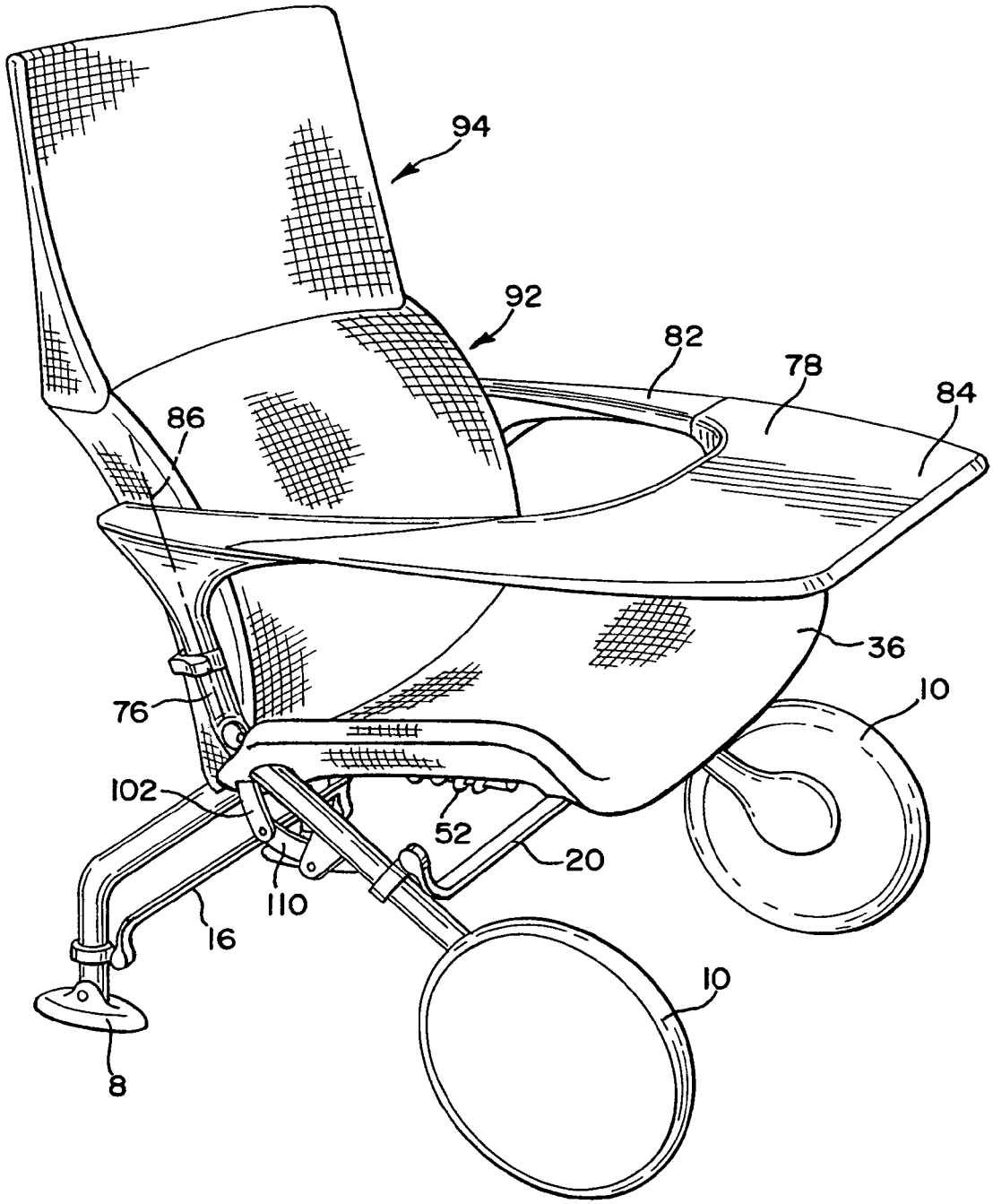
FIG. 9 is a perspective view of an alternative embodiment of a tilt chair with a pair of worksurfaces in a closed position.
Figure 10:
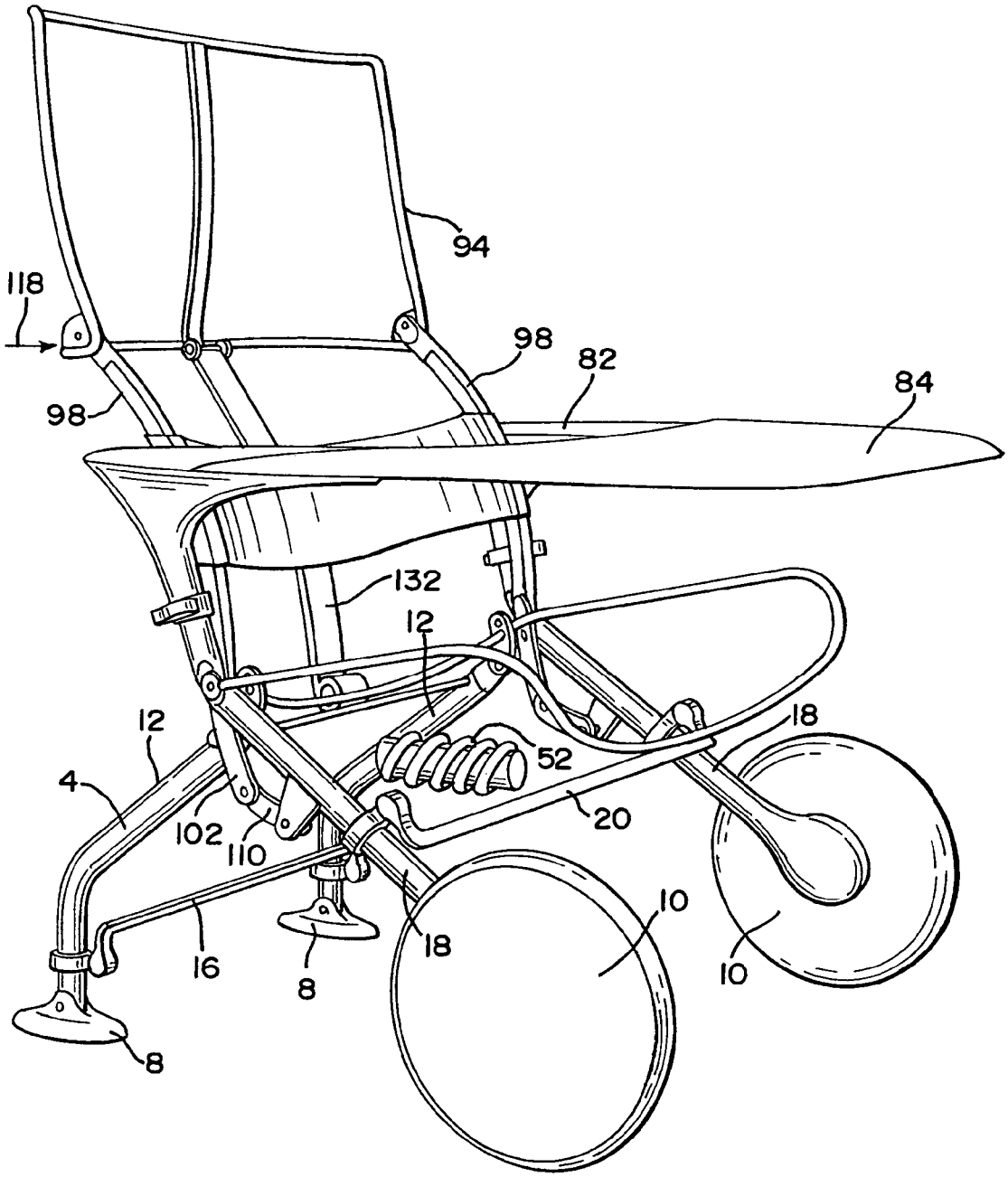
FIG. 10 is a perspective view of the tilt chair shown in FIG. 9 without the seating surfaces.
Figure 11:
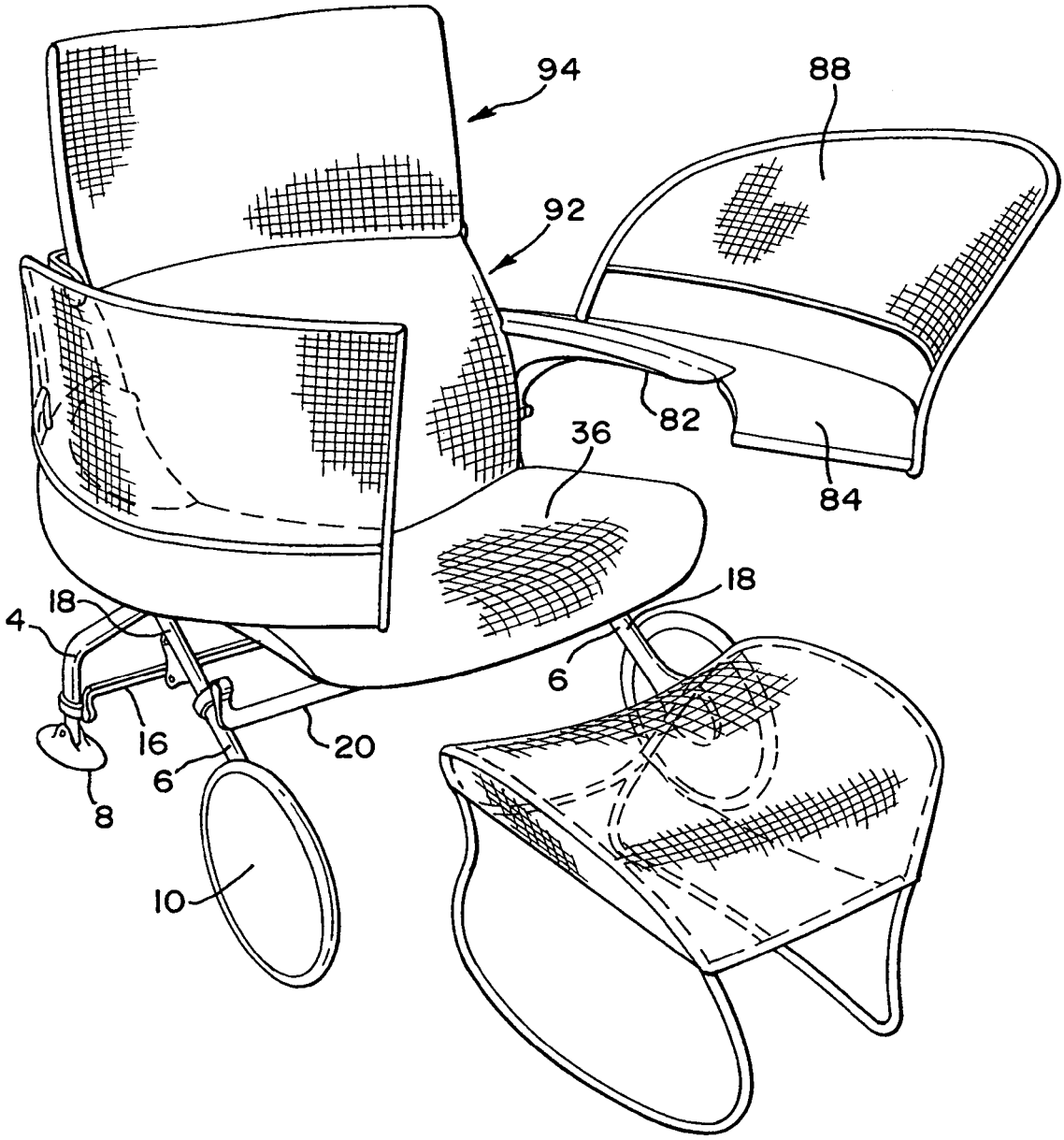
FIG. 11 is perspective view of the tilt chair shown in FIG. 9 with the worksurfaces in an open position.

Seat Support Structure:

Referring to the drawings, FIGS. 1, 2 and 9–11 show preferred embodiments of the chair 2 having a first leg 4, a second leg 6, a foot 8 and a moveable support member 10. In a preferred embodiment, the first leg includes a pair of leg members 12 connected with a cross member 14. As shown in the embodiment of FIGS. 1 and 2, the leg members 12 and cross member 16 are integrally formed as a single unit. Alternatively, as shown in the embodiment of FIGS. 9–11, the leg members 12 and cross member 16 are formed as separate members. It should be understood that in an alternative embodiment, the leg members are not connected with a cross member. It should also be understood that the first leg can be formed as a single leg member.

In one embodiment, one or more power/data modules 152 can be connected to the leg member, and the cross member 16 in particular.

Each of the leg members 12 has a first, lower end pivotally mounted to the foot member 8 about a pivot axis 22. The foot member 8 has a bottom surface 24 that is supported on the floor 26, preferably in a non-moveable relationship thereto. For example, the bottom surface 24 can be configured with a grippable material, such as rubber, that provides a relative high coefficient of friction such that the foot member does not tend to slide on the floor.

The second leg 6 also includes a pair of leg members 18 connected with a cross member 20. Alternatively, the legs members are not connected with a cross-member. The cross member can be integrally formed with the leg members, or it can be formed as a separate member. It should be understood that the second leg can be formed as a single leg member.

Each of the leg members 18 has a first, lower end rotatably mounted to the moveable support member 10 about a pivot axis 28. Preferably, the moveable support member 10 is configured as a wheel. In a preferred embodiment, the wheels have a diameter of between about 6 and 12 inches, more preferably between about 9 and 10 inches, and more preferably at least 9 inches, which allows the wheels to roll easily on carpet and other surfaces. The wheels are preferably made with an aluminum hub insert molded in a urethane (TPU) material, although it should be understood that they can be made of various metals and elastomeric materials, such as rubber the like. In other embodiments, the moveable support member is configured as a slide member, which may or may not be pivotally connected to the leg, and which slides on the floor. In another embodiment, the moveable slide member is configured as a carriage pivotally mounted to the leg and having one or more wheels rotatably mounted thereto.

The leg members 18 each have a second, upper portion that is pivotally mounted to a second upper end of the leg members 12 about a pivot axis 30. In a preferred embodiment, the leg members 12 extend generally upward and forward from the pivot axis to the pivot axis. The cross members preferably connect the leg members at a point between the pivot axes.

It should be understood that the moveable support member 10 can be supported on a track (not shown), which can be connected to the chair, for example the foot. It should be understood that the term "floor" or "support surface" would include such a track. Accordingly, any reference to the foot and the moveable support member being supported on a floor or support surface refers to the foot being directly supported by the floor and the moveable support member being indirectly supported thereon, for example by way of the track or other structure, the foot being indirectly supported and the moveable support member being directly supported by the floor, or both members being directly or indirectly supported.

It should be understood that the location of the foot and moveable support member can be reversed, with the rear leg having the moveable support member and the front leg having the stationary foot.

Referring to FIGS. 1–3 and 4–8, a pair of seat supports 32 are connected to and extend forwardly from the upper portions of the leg members 18. In one embodiment, the seat supports 32 are integrally formed with the leg members 18. Alternatively, as shown in the embodiment of FIGS. 9–11, the seat support 34 is made as a separate member from the leg members 18 and is connected thereto, for example and without limitation, with mechanical fasteners, welding and the like.

Referring to FIGS. 1–8, a seat 36 is mounted on the seat supports 32. In one embodiment, the seat includes a frame 38 having a central opening 40 and a membrane 42 secured to the frame over the opening. A cover member 44 can be secured over the membrane and frame around a periphery thereof. The seat can be made as disclosed for example and without limitation in U.S. Ser. No. 10/365,682, filed Feb. 12, 2003 and entitled "Tilt Chair Having A Flexible Back, Adjustable Armrests and Adjustable Seat Depth, and Methods for the Use Thereof," the entire disclosure of which are hereby incorporated herein by reference. In other embodiments, the seat can be formed from a frame having an elastic membrane secured thereto, as disclosed for example and without limitation, in U.S. Pat. No. 6,059,368 and U.S. patent application Ser. No. 09/855,369, filed May 15, 2001 and entitled Office Chair, the entire disclosures of which are hereby incorporated herein by references.

Alternatively, the seating surface can simply comprise a fabric wrapped around the frame, or formed as a sock that fits over the frame, and is secured thereto in various known ways. As shown in the embodiment of FIGS. 9–11, the seat support is formed as a frame that supports the seating surface member 46 or material. In other embodiments, the seating surface can be formed from a cushion or a flexible mat, one or both of which are connected to the seat support.

Referring to FIGS. 1–8, an actuator 48 extends between and is connected to the cross-members 16, 20 of the first and second legs. In particular, each cross member 16, 20 is provided with a pair of flanges 50 extending forwardly and rearwardly therefrom respectively. In one embodiment, the actuator 48 includes a threaded screw assembly and motor, which extends and retracts the screw in response to an input from a user. The actuator can be activated for example and without limitation by a push button, switch or lever. In other embodiments, the actuator can be formed as a pneumatic or hydraulic actuator, for example a pneumatic spring, which can be actuated by way of push button to extend. In yet another embodiment, shown in FIG. 10, the actuator is a simple coil spring 52 that extends between the cross members 16, 20 and applies a compressive or tensile force therebetween. In another embodiment, the spring is a torsion spring, for example a coil spring or a torsilastic spring, that acts between the first and second leg members.

In one preferred embodiment, the actuator 48 is extended by the user so as to pivot the leg 6 and seat 36 relative to the leg 4 about the pivot axis 30. At the same time, the moveable support member 10 moves along the floor 26, for example by way of the wheels rolling thereon, while the leg 4 pivots about the axis 22 relative to the foot 8. The user can thereafter disengage the actuator 48 when a desired position is reached, thereby maintaining the chair in a desired static position.

In another embodiment, which includes a spring actuator 52, the chair 2 is dynamic, and is tilted rearwardly in response to the weight or force of the user, with the spring 52 providing a biasing force.

Armrests and Worksurfaces:

Referring to FIGS. 1–8, a forward end 54 of each seat support 32 includes a socket, which is shaped to receive a post assembly 56 defining a generally vertical pivot axis 58. The post assembly can secured to the end 54 with a fastener or the like. A pair of armrests 60 each include a support arm 62 pivotally mounted on one of the post assemblies 56. The support arm includes a bushing mounted on the post assembly 56 and is vertically supported by a clamp, such as a bicycle seat post clamp, which can be "quick-release." Preferably, the support arms 62 extend generally rearwardly and each have a vertically oriented post formed at an end thereof and defining a generally vertical pivot axis 64. The term "vertical" as used herein means substantially vertical, or between about 45 degrees and about 135 degrees relative to the horizontal. An arm support member 66 is pivotally mounted to the end of the support arm 62, for example with a collar forming a socket, and is pivotal relative thereto about the pivot axis 64, or about some other substantially vertical axis. The arm support member 66 is preferably provided with an arm pad. Of course, it should be understood that the post and socket can be formed in either component, with the other component having the other of a post and socket.

A second post assembly 68 pivotally engages the first post assembly, and in one embodiment fits within the first post assembly with a bearing disposed therebetween. In one embodiment, a pneumatic shock absorber is disposed between the first and second post assemblies and absorbs loading on the worksurfaces. A worksurface assembly includes a support arm 70 that is pivotally mounted to a top of the second post assembly 68, for example with a collar or socket fitting over an upwardly extending post on the post assembly. The support arm 70 includes an end defining a second vertical axis 74, with a worksurface 72 pivotally mounted thereto about the axis, or some other substantially vertical axis. In one embodiment, the worksurface, or a fitting secured thereto, includes a collar or socket that fits over an upwardly extending post formed on the support arm 70. Of course, it again should be understood that the post and socket features can be formed on the opposite components. The worksurface 72 can assume any desired shape, and the generally circular and rectangular shapes are meant to be illustrative rather than limiting.

The worksurfaces 72, armrests 60 and support arms 70 are fixedly connected to the support arms 66, 62 and posts 68 respectively using two pins at each mounting location. The support arms 66, 62 or posts 68 are each formed with a circumferential groove. For example, the post has a metal plug with a circumferential groove formed therein. A pair of pins is disposed through the worksurface (e.g., a bottom fitting or collar), armrest 60 and support arm 70 on opposite sides of the respective post and are disposed in the groove. In this way, the pins and worksurfaces, armrests and support arms can rotate about the post, but with the pins engaging the groove to prevent the worksurfaces, armrests and support arms from being removed vertically.

The pins are pressed through holes in the arm, worksurface or support; an internal (delrin) bushing and into the groove formed in the support arms and posts. The pin is pressed until it reaches the other side of the mount. The pins can be roll/spring pins or solid metal pins that are held in place mechanically or otherwise.

In one embodiment, the upper post can be vertically moveable within the lower post, and can be clamped thereto with a clamp. In other embodiments, the clamp supports the bottom of the support arm. It should be understood that the support arms can be rotatably supported by other various pin and bearing structures that are well known to those skilled in the art.

In operation, the user can rotate the worksurfaces 72 about the vertical axis 58, rotate the support arm 62 about the vertical axis 58, rotate the arm support member 66 about the vertical axis 64 and the support arm 70 about the vertical axis 74. In this way, the user can move the various worksurfaces and armrests to various desired working positions.

In an alternative embodiment shown in FIGS. 9–11, a post assembly 76 is connected to each leg member 18 adjacent the upper portion thereof. A pair of worksurfaces 78 are pivotally mounted to the post assemblies 76 about a substantially vertical pivot axis 80. The worksurfaces 78 include a forwardly extending arm support portion 82, which can be configured with an arm pad, and a laterally extending worksurface portion 84. The worksurfaces 78 can be pivoted between a closed position, wherein inner side edges 86 of the worksurfaces abut with the worksurfaces surrounding the user, and an open position, wherein the inner side edges 86 are spaced apart and the worksurfaces are separated so as to permit the user to exit the chair. One or more screens 88 can be secured to the worksurfaces 78, for example along an outer periphery thereof, so as to provide the user with privacy.

In either embodiment, the worksurfaces are preferably substantially horizontal when the chair is in the upright, normal at-rest position. In addition, the worksurfaces tilt with the seat support and user as the chair is tilted rearwardly.

The posts 56, 68 are preferably made of metal, such as steel. The armrests are made of an assembly of plastic with a covered foam. The armrests can be covered with a variety of materials including without limitation vinyl, fabric or leather. The worksurfaces are MDF with a protective coating of either FormCoat or laminate. The outer edge of the worksurfaces are made of a soft durometer urethane.

Backrest:

Referring to FIGS. 1–11, a backrest 90 includes a lower back member 92 and an upper back member 94. The lower back member 92 is pivotally secured to the leg members 12 at a pivot axis 96 that is spaced below the pivot axis 30. In one embodiment, the lower back member 92 includes a pair of generally vertical uprights 98 having an upper, first end 100, a lower, second end 102 and a horizontal cross-member 104 extending between and connecting the uprights. The cross member 104 is generally rearwardly curved so as to not interfere with the user's back. The lower end of each upright has a cutout 106 that mates with the pivot axis 30 such that the lower back member 92 does not impede or interact therewith. The lower end 102 is further connected to a first end 108 of a restraining link 110 at a pivot axis 114 spaced below the pivot axis 30. A second end 112 of the restraining link 110 is pivotally connected to the leg member 18 at a pivot axis 116 that is positioned between the pivot axes 30, 28. A handle 154 extends between the uprights of the lower back member and is secured thereto. The handle can be grasped by the user to move the chair for transport between locations.

Referring to FIGS. 1–3 and 6–8, the upper back member 94 is pivotally mounted to the lower back member 92 at the upper ends 100 of the uprights at a pivot axis 118. The upper back member 94 includes a frame 120 having a pair of side members 122 and an upper and lower cross member 124, 126 connected thereto. A pair of flanges 128 extend downwardly and fowardly from the bottom cross member 126, which is rearwardly curved, and define a pivot axis 130 spaced rearwardly of the pivot axis. An upper back link 132 has a first, upper end 134 pivotally connected to the flanges 128 of the upper back member at the pivot axis 130. The upper back link 132 has a downwardly extending portion 136 and a forwardly extending portion 138, which defines a second, lower end 140 that is pivotally connected to the leg 4 about a pivot axis 142. In particular, a support 144 is mounted to a center portion of the cross member 16 and has a pair of flanges 14 that extend upwardly and forwardly from the cross member 16. The flanges 14 have a pair of openings defining the pivot axis 142.

A seat support member 146, such as a fabric or elastic membrane, is secured to or fitted over the upper and lower back members 92, 94. Referring to FIG. 10, a body support member 148, such as a lumbar support, can be secured between the uprights to provide additional support for the user's back.

In operation, as the user actuates the actuator 48, or tilts rearwardly against the biasing force of the actuator spring 52, the leg 6, and in particular the leg members 18 pivot the restraining links 110, which in turn pivots the lower back member 92 relative to the leg 4 and leg members 12 about the pivot axis 96. At the same time, the upper back link 132 pivots the upper back member 94 forwardly relative to the lower back member 92 about the pivot axis 118, so as to provide support for the user's thoracic region, or upper back and shoulders, and maintain the upper back member in a substantially vertical position.

It should be understood that the legs 4, 6 and upper and lower back members 92, 94 can be made of plastic or magnesium as shown in FIGS. 1–8, or can be formed from various metals, such as aluminum or steel, as shown in FIGS. 9–11. It should be understood that the various pivot joints between various components are preferably configured with an axle, which can be a separate part, or integral to one or more of the legs, foot, moveable support member, restraining link, upper back link, upper back member and/or lower back member.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A tilt chair comprising:

a foot adapted to be supported by a support surface;

a first leg pivotally mounted to said foot at a first horizontal axis;

a second leg pivotally mounted to said first leg at a second horizontal axis, wherein said second axis is spaced from said first axis;

a moveable support member mounted to said second leg at a location spaced from said first and second axes, said moveable support member adapted to be moveably supported by the support surface, wherein said moveable support member is moveable in a first and second direction toward and away from said foot respectively as said first leg pivots relative to said second leg about said second axis and said first leg pivots relative to said foot about said first axis; and an actuator operably connected to said first and second legs at first and second locations spaced from said second axis respectively.

2. The tilt chair of claim 1 wherein said moveable support member is rotatably mounted to said second leg at a third horizontal axis spaced from said first and second axes.

3. The tilt chair of claim 2 wherein said moveable support member is a wheel.

4. The tilt chair of claim 1 wherein said first leg comprises a pair of first leg members connected with a first cross member and wherein said second leg comprises a pair of second leg members connected with a second cross member, wherein said first and second locations are positioned on said first and second cross members respectively.

5. The tilt chair of claim 1 further comprising a seat support connected to said second leg.

6. The tilt chair of claim 5 further comprising an armrest mounted to said seat support.

7. The tilt chair of claim 6 wherein said armrest is pivotally mounted to said seat support about a vertical axis.

8. The tilt chair of claim 7 wherein said vertical axis comprises a first vertical axis and said armrest comprises an armrest support pivotally mounted to said seat support about said first vertical axis, and wherein said armrest further comprises an arm support member pivotally mounted to said armrest support at a second vertical axis spaced from said first vertical axis.

9. A tilt chair comprising:

a foot adapted to be supported by a support surface;

a first leg pivotally mounted to said foot at a first horizontal axis;

a second leg pivotally mounted to said first leg at a second horizontal axis, wherein said second axis is spaced from said first axis;

a moveable support member mounted to said second leg at a location spaced from said first and second axes, said moveable support member adapted to be moveably supported by the support surface, wherein said moveable support member is moveable in a first and second direction toward and away from said foot respectively as said first leg pivots relative to said second leg about said second axis and said first leg pivots relative to said foot about said first axis; and a lower back member having a lower end pivotally mounted to said first leg at a fourth horizontal axis spaced from said second axis.

10. The tilt chair of claim 9 further comprising an upper back member pivotally mounted to an upper end of said lower back member at a fifth horizontal axis.

11. The tilt chair of claim 10 further comprising an upper back link having a lower end pivotally mounted to said first leg at a sixth horizontal axis and an upper end pivotally mounted to said upper back member at a seventh horizontal axis spaced from said fifth axis.

12. The tilt chair of claim 9 further comprising a restraining link having a first end pivotally mounted to said lower end of said lower back member at a fifth axis spaced from said fourth axis and a second end pivotally mounted to said second leg at a sixth axis spaced from said second axis.

13. A tilt chair comprising:

a foot adapted to be supported by a support surface;

a first leg pivotally mounted to said foot at a first horizontal axis;

a second leg pivotally mounted to said first leg at a second horizontal axis, wherein said second axis is spaced from said first axis;

a moveable support member mounted to said second leg at a location spaced from said first and second axes, said moveable support member adapted to be moveably supported by the support surface, wherein said moveable support member is moveable in a first and second direction toward and away from said foot respectively as said first leg pivots relative to said second leg about said second axis and said first leg pivots relative to said foot about said first axis;

a seat support connected to said second leg;

an armrest mounted to said seat support, wherein said armrest is pivotally mounted to said seat support about a vertical axis; and a worksurface pivotally mounted to said seat support about said vertical axis, wherein said worksurface and said armrest are independently pivotable about said vertical axis.

14. A tilt chair comprising:

a foot adapted to be supported by a floor;

a first leg pivotally mounted to said foot at a first horizontal axis;

a second leg pivotally mounted to said first leg at a second horizontal axis, wherein said second axis is spaced from said first axis;

a wheel rotatably mounted to said second leg at a third horizontal axis spaced from first and second axes, said wheel is adapted to be supported by the floor, wherein said wheel is rotatable in a first and second direction toward and away from said foot respectively as said first leg pivots relative to said second leg about said second axis and said first leg pivots relative to said foot about said first axis;

a lower back member having a lower end pivotally mounted to said first leg at a fourth horizontal axis spaced from said second axis; and a restraining link having a first end pivotally mounted to said lower end of said lower back member at a fifth axis spaced from said fourth axis and a second end pivotally mounted to said second leg at a sixth axis spaced from said second axis.

15. The tilt chair of claim 14 further comprising an upper back member pivotally mounted to an upper end of said lower back member at a seventh horizontal axis, and an upper back link having a lower end pivotally mounted to said first leg at a eighth horizontal axis and an upper end pivotally mounted to said upper back member at a ninth horizontal axis spaced from said seventh axis.

16. The tilt chair of claim 15 wherein said first leg comprises a pair of first leg members connected with a first cross member, and wherein said lower end of said upper back link is pivotally mounted to said first cross member at said eight horizontal axis.

17. The tilt chair of claim 16 wherein said second leg comprises a pair of second leg members connected with a second cross member.

18. The tilt chair of claim 17 further comprising an actuator operably connected to said first and second cross members at first and second locations spaced from said second axis respectively.

19. The tilt chair of claim 14 further comprising a seat support having a first end connected to said second leg proximate said second axis and a second end extending forwardly therefrom.

20. The tilt chair of claim 19 further comprising an armrest mounted to said second end of said seat support.

21. The tilt chair of claim 20 wherein said armrest is pivotally mounted to said seat support about a vertical axis.

22. The tilt chair of claim 21 further comprising a worksurface pivotally mounted to said seat support about said vertical axis, wherein said worksurface and said armrest are independently pivotable about said vertical axis.

23. A method of tilting a chair comprising:

providing a tilt chair comprising a foot supported by a support surface; a first leg pivotally mounted to said foot at a first horizontal axis; a second leg pivotally mounted to said first leg at a second horizontal axis, wherein said second axis is spaced from said first axis; and a moveable support member rotatably mounted to said second leg at a third horizontal axis spaced from first and second axes, wherein said moveably support member is supported by said support surface;

pivoting said second leg relative to said first leg about said second pivot axis and thereby moving said moveable support member on said support surface and pivoting said first leg relative to said foot about said first axis; and providing a lower back member having a lower end pivotally mounted to said first leg at a fourth horizontal axis spaced from said second axis, and pivoting said lower back member about said fourth axis as said second leg is pivoted relative to said first leg.

24. The method of claim 23 wherein said pivoting said second leg relative to said first leg comprises moving first and second locations on said first and second legs respectively toward and away from each other with an actuator.

25. The method of claim 23 further comprising providing an upper back member pivotally mounted to an upper end of said lower back member at a fifth horizontal axis, and pivoting said upper back member relative to said upper end of said lower back member about said fifth horizontal axis.

26. The method of claim 25 further comprising providing an upper back link having a lower end pivotally mounted to said first leg at a sixth horizontal axis and an upper end pivotally mounted to said upper back member at a seventh horizontal axis spaced from said fifth axis, and wherein said pivoting said upper back member relative to said upper end of said lower back member comprises pivoting said lower end of said upper back link relative to said first leg about said sixth axis and pivoting said upper end of said upper back link relative to said upper back member about said seventh axis.

27. The method of claim 23 further comprising providing a restraining link having a first end pivotally mounted to said lower end of said lower back member at a fifth axis spaced from said fourth axis and a second end pivotally mounted to said second leg at a sixth axis spaced from said second axis, and wherein said pivoting said lower back member about said fourth axis as said second leg is pivoted relative to said first leg comprises pivoting said first end of said restraining link relative to said lower back member about said fifth axis and pivoting said second end of said restraining link relative to said second leg about said sixth axis.

28. The method of claim 23 further comprising providing a seat support connected to said second leg, and wherein pivoting said second leg relative to said first leg about said second pivot axis comprises pivoting said seat support relative to said first leg about said second pivot axis.

29. The method of claim 28 further comprising providing an armrest mounted to said seat support.

30. The method of claim 29 wherein said armrest is pivotally mounted to said seat support about a vertical axis, and further comprising pivoting said armrest about said vertical axis.

31. The method of claim 30 wherein said vertical axis comprises a first vertical axis and said armrest comprises an armrest support pivotally mounted to said seat support about said first vertical axis, and wherein said armrest further comprises an arm support member pivotally mounted to said armrest support at a second vertical axis spaced from said first vertical axis, and further comprising pivoting said arm support member relative to said armrest support about said second vertical axis.

32. The method of claim 23 wherein said moving said moveable support member on said support surface comprises rolling a wheel on said support surface.

33. A method of tilting a chair comprising:

providing a tilt chair comprising a foot supported by a support surface; a first leg pivotally mounted to said foot at a first horizontal axis; a second leg pivotally mounted to said first leg at a second horizontal axis, wherein said second axis is spaced from said first axis; and a moveable support member rotatably mounted to said second leg at a third horizontal axis spaced from first and second axes, wherein said moveably support member is supported by said support surface;

pivoting said second leg relative to said first leg about said second pivot axis and thereby moving said moveable support member on said support surface and pivoting said first leg relative to said foot about said first axis;

providing a seat support connected to said second leg, and wherein pivoting said second leg relative to said first leg about said second pivot axis comprises pivoting said seat support relative to said first leg about said second pivot axis;

providing an armrest mounted to said seat support, wherein said armrest is pivotally mounted to said seat support about a vertical axis, and further comprising pivoting said armrest about said vertical axis; and providing a worksurface pivotally mounted to said seat support about said vertical axis, and pivoting said worksurface about said vertical axis independently of said armrest.

34. A method of tilting a chair comprising:

providing a tilt chair comprising a foot supported by a support surface; a first leg pivotally mounted to said foot at a first horizontal axis; a second leg pivotally mounted to said first leg at a second horizontal axis, wherein said second axis is spaced from said first axis; and a moveable support member rotatably mounted to said second leg at a third horizontal axis spaced from first and second axes, wherein said moveably support member is supported by said support surface;

pivoting said second leg relative to said first leg about said second pivot axis and thereby moving said moveable support member on said support surface and pivoting said first leg relative to said foot about said first axis;

providing a seat support connected to said second leg, and wherein pivoting said second leg relative to said first leg about said second pivot axis comprises pivoting said seat support relative to said first leg about said second pivot axis; and providing a worksurface mounted to said seat support, and wherein said pivoting said seat support relative to said first leg about said second pivot axis further comprises pivoting said worksurface with said seat support relative to said first leg about said second pivot axis.

* * * * *

UNITED STATES PATENT AND TRADEMARK OFFICE

CERTIFICATE OF CORRECTION

PATENT NO. : 7,207,629 B2
APPLICATION NO. : 10/860804
DATED : April 24, 2007
INVENTOR(S) : Mark W. Goetz et al.

It is certified that error appears in the above-identified patent and that said Letters Patent is hereby corrected as shown below:

On the Title Page item 57

In column2 , line 6, under "ABSTRACT", before "support member is" delete "moveably" and substitute --moveable-- in its place.

In the Claims

Column 10, line 1, before "eighth horizontal" delete "a" and substitute --an-- in its place.

Column 10, line 8, before "horizontal axis" delete "eight" and substitute --eighth-- in its place.

Column 10, line 36, after "wherein said" delete "moveably" and substitute --moveable-- in its place.

Column 11, line 43, after "wherein said" delete "moveably" and substitute --moveable-- in its place.

Column 12, line 26, after "wherein said" delete "moveably" and substitute --moveable-- in its place.

Signed and Sealed this

Thirtieth Day of October, 2007

JON W. DUDAS
*Director of the United States Patent and Trademark Office*